United States Patent [19]

Bene

[11] Patent Number: 4,896,516

[45] Date of Patent: Jan. 30, 1990

[54] DYEING MACHINE WITH DEBLOCKING MECHANISM

[75] Inventor: Armand Bene, Saint-Priest, France

[73] Assignee: MADINOX S.A., Saint Priest Mi Plaine, France

[21] Appl. No.: 219,283

[22] Filed: Jul. 14, 1988

[30] Foreign Application Priority Data

Jul. 15, 1987 [FR] France ..... 87 10494

[51] Int. Cl.[4] ..... D06B 3/24

[52] U.S. Cl. ..... 68/13 R; 68/177; 68/184; 26/74

[58] Field of Search ..... 68/13 R, 177, 178, 184; 26/74; 226/25, 26

[56] References Cited

U.S. PATENT DOCUMENTS 1,977,720 10/1934 Fowler ..... 26/74 X
3,556,369 1/1971 Ferguson ..... 226/25
3,777,959 12/1973 Seney ..... 226/25
3,779,049 12/1973 Becker ..... 68/177 X
3,971,236 7/1976 Bene .
4,440,003 4/1984 Koch ..... 68/177 X
4,630,340 12/1986 Bauer ..... 28/187

FOREIGN PATENT DOCUMENTS 0047348 3/1982 European Pat. Off. ..... 28/242

*Primary Examiner*—Frankie L. Stinson
*Attorney, Agent, or Firm*—Herbert Dubno

[57] ABSTRACT

A dyeing machine is provided along the drive withdrawn from a storage zone for the web with a monitor of the continuous displacement of the web and, therebelow, a mechanism for applying traction controlled by the web-advance monitor. The tractive mechanism can be a ring normally traversed without contact by web and rotated about a diametral axis to apply traction or a pincer which is clamped on the web and then raised to apply traction.

14 Claims, 3 Drawing Sheets

DYEING MACHINE WITH DEBLOCKING MECHANISM

FIELD OF THE INVENTION

My present invention relates to a dyeing machine for dyeing textile material in rope form with a deblocking mechanism and, more particularly, to a dyeing machine for the automatic deblocking of the textile material to be dyed which can be guided through a machine and can accumulate in a storage zone thereof.

BACKGROUND OF THE INVENTION

In dyeing machines of the type in which a textile web, e.g. a yarn, in rope form is dyed by circulating the web through a liquid dye so that a collection of the web accumulates in a storage zone of the path through the machine, it is possible that the continuous advance of the web may be interrupted by a blocking of the loops of the web which are formed.

In such a machine, the textile workpiece may be a hank of yarn, braid, woven or other tubular material, closed on itself and may be guided repeatedly through the bath of dye disposed at the lower part of the machine. At some point along the path, a storage zone can be formed, e.g. in the bath at the lower part of the machine, in which storage of the web is effected in the form of accordion folds or loops, a strand emerging from this zone and extending through the upper zone of the machine, passing into contact with the guide means or entrainment means which may be provided in this upper zone.

The web is thus continuously displaced and he accordion folds are reformed in a region at which the descending strand enters the storage zone which, as noted, may contain the bath of dye.

The machine of this type is described in my U.S. Pat. No. 3,971,236, for example.

The textile material or rope forming the web may be any dyeable material and, while a hank of yarn may be a preferred workpiece to be dyed, knitted or woven fabrics, preferably tubular fabrics, may be dyed in a similar manner. All of these materials will be included in the term web' as this term is used herein.

The means for entraining the web through the machine can include a motorized roller or reel mounted in an upper part of the machine and can include means for holding the web against this roller or reel. It also may comprise nozzle means for pneumatic transport of the web or even a combination of nozzles and rollers or reels for a combined pneumatic and frictional or positive displacement.

The fabric stored in the storage zone of the machine, however, acts as an obstruction in many cases to the oncoming web and thereby disturbs the optimum positioning of the accordion folds and the like. In addition, an oscillation can develop in the stored portion of the web which can contribute to disturbance of the stored quantity to the point that withdrawal of the web can be blocked.

Such blockage can give rise to dyeing defects and can be prejudicial to the quality of the finished product.

While this problem is particularly significant in the case in which the displacement of the web is effected only pneumatically by air jets from respective nozzles, because ascent of the web is prevented and the force generated by the pneumatic displacement medium cannot overcome the resistance to circulation of the fabric, it is also a problem with reels and the like which exert mechanical traction upon the web.

OBJECTS OF THE INVENTION

It is, therefore, the principal object of the present invention to provide an improved device or mechanism for the automatic deblocking of a workpiece circulated in a dyeing machine of the type described.

Another object of my invention is to provide an improved dyeing machine with means for deblocking the circulation of the web, fabric or workpiece which is to be dyed.

SUMMARY OF THE INVENTION

Essentially these objects are attained, in accordance with the invention, by a combination of two means disposed along the strand of the web at the outlet side of the storage zone, namely a control means monitoring the advance of the web on the one hand and, on the other hand, a means adapted to apply a traction to this strand of the web in the direction of advance of the latter and responsive to the control means so that this tractive means becomes effective when the control means monitoring the advance of the web detects a halting of the latter.

The dyeing machine for dyeing textile goods in rope form, in accordance with the invention thus preferably comprises:

a vessel containing a dyeing liquid;

means in the vessel for circulating a fabric web to be dyed along a path through the dyeing liquid in the vessel and defining a storage zone in the vessel along the path in which the web collects, a stretch of the web path leading toward the zone, and a stretch of the web path leading away from the zone;

control means in the vessel disposed along the stretch of the web path leading away from the zone and monitoring a strand of the web leaving the zone for monitoring advance of the web along the path; and tractive means in the vessel operatively responsive and connected to the control means and disposed along the stretch of the web path leading away from the zone and engageable with the strand for exerting a tractive force thereon in a direction tending to advance the web along the path upon detection by the control means of a halting of the web.

Should the web be halted along this recirculating path, for example, because the force exerted by the normal means for displacing the web is less than the resistance of the web to such displacement because of a poor arrangement of the web on the bottom of the machine, this halt is detected and in response to such detection, a traction is exerted on the web of a magnitude greater than that applied by the means for normal circulation of the web.

According to a best-mode embodiment of the invention, the means for amending the advance of the web is constituted by a free-running roller having a horizontal axis and contacted by the rising strand of the web from the storage zone so that this roller is frictionally entrained to rotate by the unthreading movement of the web, i.e. the withdrawal of the strand from the collection of accordion folds at the bottom of the machine. This roller is provided with a sensor which is responsive to its rotary movement.

Advantageously, the sensing means is constituted by a magnet fixed on one endface of the roller and eccentric with respect to its axis, and an electromagnetic detector fixed on a wall of the machine, e.g. the vessel containing the dying bath and juxtaposed with the orbit of the magnet. The detector is designed to generate the signal if the frequency of the pulses it receives from the magnet is less than a predetermined value.

In a preferred embodiment of the invention in which the storage zone for the fabric is located at a lower part of the machine, the tractive means triggered by this sensor exercises an upward traction upon the wobble.

According to another feature of the invention, the means for applying traction in an upward traction to the web can be located below the monitoring means, thereby allowing the means for applying traction to the web to operate with maximum efficiency.

The latter means can be constituted by a circular ring mounted to pivot about a horizontal axis along the diameter of the ring and capable of being rotated about this axis from a normal horizontal position in which the ring passes without contact, the upwardly moving strand of the web.

There thus is no frictional engagement of the web with the ring. However, when the monitoring means detects an interruption in impediment in the advance of the web, this ring can be rotated about its pivot axis through a predetermined angular displacement to draw the web upwardly, before the ring is returned to its initial position.

According to another embodiment of the invention, the means adapted to apply traction to the web can be constituted by a pincer having two jaws disposed in a common horizontal plane and flanking the strand without contact in an open position of the pincer corresponding to normal advance of the strand. When, however, the monitoring means detects a failure in such advance, the pincer closes and is displaced upwardly while gripping the strand through a predetermined displacement before the pincer opens and is lowered to its original position.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
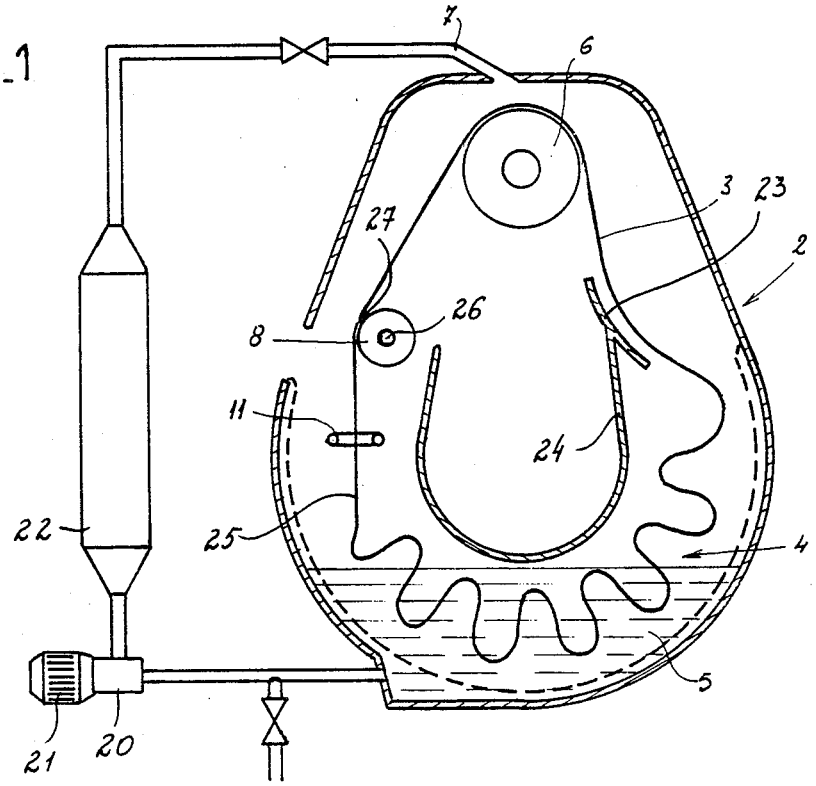
FIG. 1 is a vertical cross-sectional view showing the dyeing machine of the invention from a side.
Figure 4:
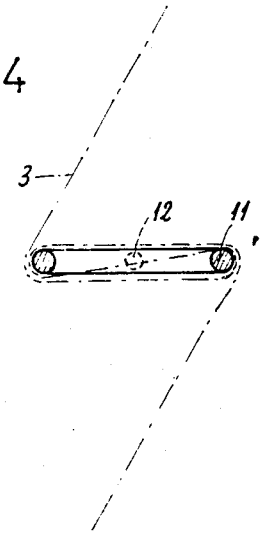
FIG. 4 is a sectional view through the ring illustrating the application of traction to the web.

FIG. 1 shows in highly diagrammatic form a machine for dyeing a hank of yarn and represented at 2 in its most general aspects, the hank 3 of yarn being closed on itself and having a part 4 disposed in the lower zone of the machine in which it is immersed in a dye bath 5. The lower zone is here the storage zone. Recirculation of the dye bath is effected by a pump 20 driven by a motor 21 and passing the liquid dye through a filter 22 before returning the dye, through a sprinkling arrangement generally denoted at 7, to the path at a location at the upper part of the machine.

Where the web emerges from the zone 4, it passes over a motor-driven upper roller 6 disposed in the upper part of the machine so that the yarn will circulate. Guides 23 and 24 may be provided to assist in this circulation.

According to the invention, the machine is equipped along the rising stretch 25 of the yarn with a means for deblocking the web.

This deblocking device comprises a roller 8 having a horizontal axis 26 mounted so as to be free to rotate about this axis and frictionally entrained by the web which forms an angle 27 enabling this roller to be driven as the web is displaced.

Figure 3:
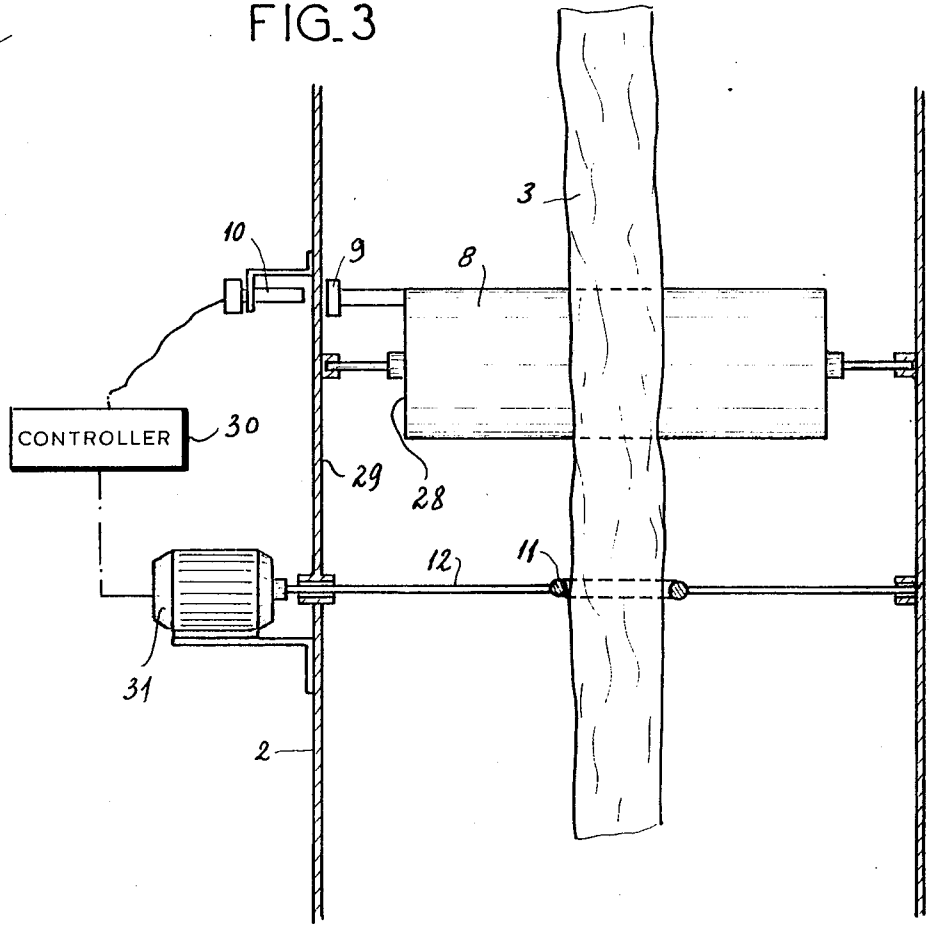
FIG. 3 is a sectional view taken in a plane perpendicular to the view seen in FIG. 2.

As can be seen from FIG. 3, the roller is provided with a sensor 9, 10 by which the rotary movement may be detected. This sensor, in the construction shown in the drawing, comprises a magnet 9 fixed on one of the end faces 28 of the roller 8 and eccentric with respect to the axis of this roller. A detector 10, which is electromagnetically responsive, is fixed on a wall 29 of the vessel containing the bath so that a chain of pulses is generated with each pulse representing a pass of the magnet 9. The pulses are applied to the electronic circuitry 30 of the detector which outputs a signal if the pulse frequency is less than a predetermined value, thereby signalling a failure of driving of the web or an undesirable reduction in the rate of advance of the web.

Figure 2:
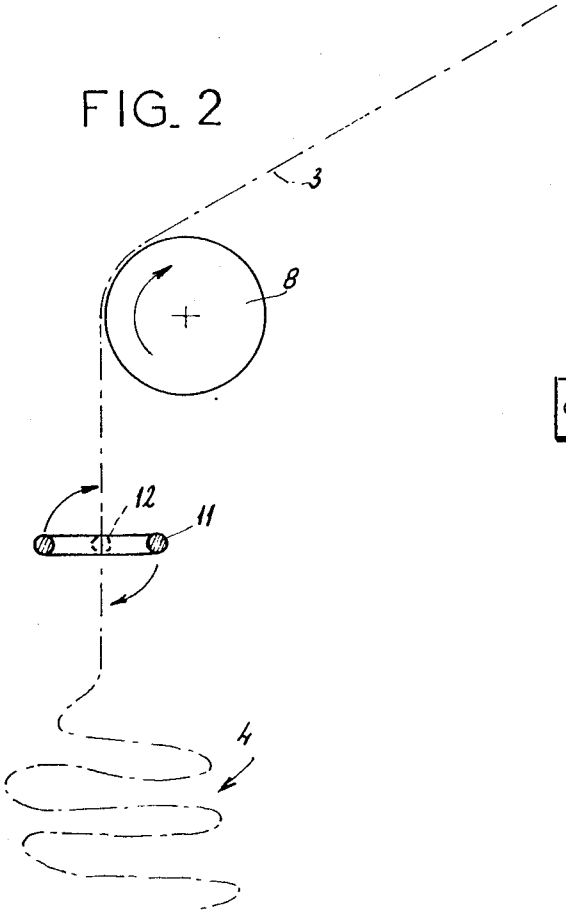
FIG. 2 is a highly diagrammatic view of the deblocking mechanism according to one embodiment of the invention.

Below the roller 8 is disposed a circular ring 11 which normally is horizontal, as can be seen in FIGS. 2 and 3, and thus is traversed without friction by the yarn. The ring 11 is mounted so that it can pivot on a horizontal axle which extends along a diameter of the ring and can be rotated by this axle via an electric motor 31 or other means not shown in the drawing.

As a consequence, while the roller 8 outputs a frequency representing normal advance of the yarn, the ring 11 remains horizontal and allows the yarn to pass freely. If, however, because of a poor arrangement of the yarn in the bath, the roller or reel 6 no longer is capable of applying sufficient traction to advance the yarn, the monitoring roller 8 will cease to rotate or will rotate at an insufficient speed. This is detected by the sensor 10 and its circuit 11 and the controller 30 thereupon output a signal to the motor 31 to cause the ring 11 to rotate from its original position as shown by the arrows in FIG. 2.

This rotation causes the strand to wind at least partially on the ring 11 and draw the strand upwardly. After a predetermined angle of rotation, the ring 11 is returned to its starting position and if the roller 8 now detects normal unthreading of the yarn, the ring 11 will remain in this position. If on the contrary the web is still blocked, the ring 11 will be again rotated to apply fresh traction to the strand.

It should thus be clear that the invention represents a major improvement over prior dyeing machines in that it can automatically relieve a blocking of the unthreading action of the yarn and maintain a uniform unthreading action with the result that dyeing will be more uniform as well.

Figure 5:
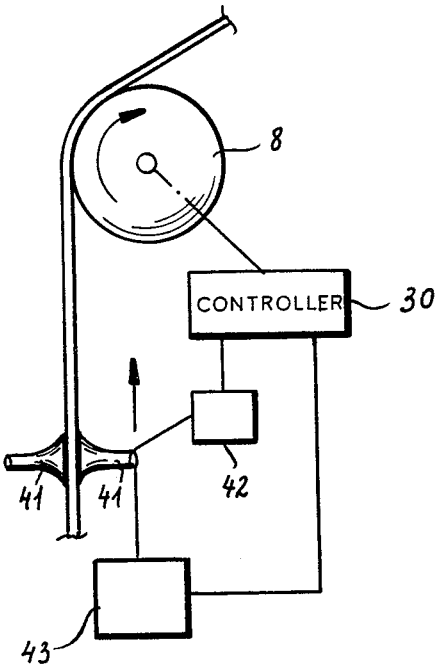
FIG. 5 is a view similar to FIG. 2 illustrating another embodiment of the invention.
Figure 6:
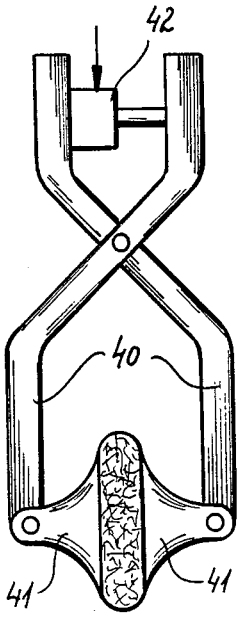
FIG. 6 is a plan view of the pincer closed on the strand.

In FIGS. 5 and 6 we have shown another mechanism for achieving this result. In this mechanism, a pincer 40 has jaws 41 normally flanking the yarn without contact and a device 42 operated by the controller 30 from the roller 8 to close the jaws on the web when entrainment of the roller 8 is slowed or is halted. The controller 30 thereupon also activates a lifting yarn 43 to raise the clamped dispenser and apply upward traction on the yarn. In its upper position, the pincer disengages from the yarn and is lowered so that the process can be repeated should the blocking of the yarn not have been relieved by the application of traction.

I claim:

1. A dyeing apparatus provided with a mechanism for automatic deblocking of the movement of dyed goods therein, said apparatus comprising:

a vessel containing a dyeing liquid; means in said vessel for circulating a fabric web to be dyed along a path through said dyeing liquid in said vessel and defining a storage zone in said vessel along said path in which said web collects, a stretch of said web path leading toward said zone, and a stretch of said web path leading away from said zone;

control means in said vessel disposed along said stretch of said web path leading away from said zone and monitoring a strand of said web leaving said zone for monitoring advance of said web along said path; and tractive means in said vessel operatively responsive and connected to said control means and disposed along said stretch of said web path leading away from said zone and engageable with said strand for exerting a tractive force thereon in a direction tending to advance said web along said path upon detection by said control means of a halting of said web.

2. The apparatus defined in claim 1 wherein said control means comprises:

a roller mounted in said vessel for rotation about a horizontal axis and free to rotate about said axis upon entrainment by said web upon passage thereof from said storage zone; and a sensor cooperating with said roller and responsive to rotation thereof.

3. The apparatus defined in claim 2 wherein said sensor comprises:

a magnet fixed on an axial end face of said roller and eccentric with respect to said axis; and an electromagnetic detector juxtaposed with said end face and fixed on a wall of said vessel relative to which said roller can rotate for generating a signal upon a frequency of pulses generated by said magnet on rotation of said roller falling below a predetermined value.

4. The apparatus defined in claim 2 wherein said storage zone is located at a bottom portion of said vessel and said tractive means is constructed and arranged to exert a lifting movement on said strand.

5. The apparatus defined in claim 4 wherein said tractive means is located below said control means.

6. The apparatus defined in claim 5 wherein said tractive means comprises:

a circular ring mounted in said vessel and traversed by said web;

means for mounting said circular ring to pivot about a substantially horizontal axis extending diametrically of the ring; and drive means connected to said ring for normally maintaining it in a horizontal plane in an initial position in which said ring is traversed by said web without friction and for rotating said ring about said substantially horizontal axis through a predetermined angle in response to said control means to exert traction on said web and thereafter returning said ring to said initial position.

7. The apparatus defined in claim 5 wherein said tractive means comprises:

a pencier having pair of jaws lying in a common horizontal plane and adapted to be closed on said strand from an initial open position enabling passage of the strand between the jaws substantially free from friction for normal advance of said web; and means for displacing said pincer vertically when said pincer is closed on said strand but returning said pincer upon opening thereof in response to said control means.

8. The apparatus defined in claim 1 wherein said storage zone is located at a bottom portion of said vessel and said tractive means is constructed and arranged to exert a lifting movement on said strand.

9. The apparatus defined in claim 8 wherein said tractive means is located below said control means.

10. The apparatus defined in claim 9 wherein said tractive means comprises:

a circular ring mounted in said vessel and traversed by said web;

means for mounting said circular ring to pivot about a substantially horizontal axis extending diametrically of the ring; and drive means connected to said ring for normally maintaining it in a horizontal plane in an initial position in which said ring is traversed by said web without friction and for rotating said ring about said substantially horizontal axis through a predetermined angle in response to said control means to exert traction on said web and thereafter returning said ring to said initial position.

11. The apparatus defined in claim 9 wherein said tractive means comprises:

a pincer having a pair of jaws lying in a common horizontal plane and adapted to be closed on said strand from an initial open position enabling passage of the strand between the jaws substantially free from friction for normal advance of said web; and means for displacing said pincer vertically when said pincer is closed on said strand but returning said pincer upon opening thereof in response to said control means.

12. The apparatus defined in claim 1 wherein said tractive means is located below said control means.

13. The apparatus defined in claim 12 wherein said tractive means comprises:

a circular ring mounted in said vessel and traversed by said web;

means for mounting said circular ring to pivot about a substantially horizontal axis extending diametrically of the ring; and drive means connected to said ring for normally maintaining it in a horizontal plane in an initial position in which said ring is traversed by said web without friction and for rotating said ring about said substantially horizontal axis through a predetermined angle in response to said control means to exert traction on said web and thereafter returning said ring to said initial position.

14. The apparatus defined in claim 12 wherein said tractive means comprises a pincer engageable with said web and means for vertically displacing said pincer.

* * * * *